US011667997B2

(12) United States Patent
Chevy et al.

(10) Patent No.: US 11,667,997 B2
(45) Date of Patent: Jun. 6, 2023

(54) LOW-DENSITY ALUMINUM-COPPER-LITHIUM ALLOY PRODUCTS

(71) Applicant: CONSTELLIUM ISSOIRE, Issoire (FR)

(72) Inventors: Juliette Chevy, Moirans (FR); Philippe Jarry, Grenoble (FR); Soizic Blais, Saint Etienne de Crossey (FR); Alireza Arbab, Rives-sur-Fure (FR)

(73) Assignee: CONSTELLIUM ISSOIRE, Issoire (FR)

( * ) Notice: Subject to any disclaimer, the term of this patent is extended or adjusted under 35 U.S.C. 154(b) by 541 days.

(21) Appl. No.: 16/603,703

(22) PCT Filed: Apr. 9, 2018

(86) PCT No.: PCT/FR2018/050887

§ 371 (c)(1),
(2) Date: Oct. 8, 2019

(87) PCT Pub. No.: WO2018/189472

PCT Pub. Date: Oct. 18, 2018

(65) Prior Publication Data

US 2020/0032378 A1 Jan. 30, 2020

(30) Foreign Application Priority Data

Apr. 10, 2017 (FR) ..... 17/53135

(51) Int. Cl.
*C22C 21/16* (2006.01)
*C22F 1/057* (2006.01)
*C22C 21/18* (2006.01)

(52) U.S. Cl.
CPC ..... *C22F 1/057* (2013.01); *C22C 21/16* (2013.01); *C22C 21/18* (2013.01)

(58) Field of Classification Search
CPC ..... C22C 1/026; C22C 1/0416; C22C 21/00; C22C 21/12; C22C 21/16; C22C 21/18; C22F 1/057
See application file for complete search history.

(56) References Cited

U.S. PATENT DOCUMENTS 4,894,096 A * 1/1990 Meyer ..... C22C 21/00 148/552
5,032,359 A 7/1991 Pickens et al.
(Continued)

FOREIGN PATENT DOCUMENTS

CN 102224267 A 10/2011
WO 2007/080267 A1 7/2007
WO WO-2015086921 A2 * 6/2015 ..... B21B 1/22

OTHER PUBLICATIONS

"Glossary of Metallurgical and Metalworking Terms," Metals Handbook, ASM Handbooks Online, ASM International, 2002, pp. 1, 12 , 257. (Year: 2002).*

(Continued)

*Primary Examiner* — Vanessa T. Luk
(74) *Attorney, Agent, or Firm* — McBee, Moore & Vanik IP, LLC

(57) ABSTRACT

The invention relates to a product made of an aluminium-based alloy comprising, by wt. %, Cu: 2.4-3.2; Li: 1.6-2.3; Mg: 0.3-0.9; Mn: 0.2-0.6; Zr: 0.12-0.18; such that Zr≥−0.06 *Li+0.242; Zn: <1.0; Ag: <0.15; Fe+Si≤0.20; optionally, at least one element selected from Ti, Sc, Cr, Hf and V, the content of the element, if selected, being: Ti: 0.01-0.1; Sc: 0.01-0.15; Cr: 0.01-0.3; Hf: 0.01-0.5; V: 0.01-0.3; other elements ≤0.05 each and ≤0.15 in total; the remainder being aluminium. The invention also relates to a method for manufacturing an as-cast aluminum alloy product according to the invention, comprising the following steps: preparing a liquid metal bath; casting an as-cast shape from said liquid (Continued)

Size of the as-cast grains (μm) of the AlCuLiMgMnZr alloys of example 1 placed in the diagram Zr (% by weight) according to Li (% by weight). The equations Zr = -0.06Li + 0.2575 and Zr = -0.06Li + 0.242 are shown.

metal bath; and solidifying the as-cast shape into a billet, a rolling plate or a forging blank; characterised in that the casting is performed without adding any grain refiner, or by adding a refiner comprising (i) Ti and (ii) B or C, such that the content of B from the refiner is less than 45 ppm, and that of C is less than 6 ppm, and/or characterised in that the casting is carried out, for an as-cast shape of thickness E or with a diameter D greater than 150 mm, at a casting rate v (mm/min) greater than 30 for a plate-type as-cast shape or 9000/D for a billet-type as-cast shape.

4 Claims, 6 Drawing Sheets

(56) References Cited

U.S. PATENT DOCUMENTS

| | | | | |
|---|---|---|---|---|
| 5,066,342 | A * | 11/1991 | Rioja | C22F 1/04 148/438 |
| 5,137,686 | A * | 8/1992 | Rioja | C22F 1/04 148/693 |
| 5,198,045 | A | 3/1993 | Cho et al. | |
| 7,229,509 | B2 | 6/2007 | Cho | |
| 8,366,839 | B2 | 2/2013 | Heymes et al. | |
| 10,190,200 | B2 | 1/2019 | Heymes et al. | |
| 2010/0126637 | A1 | 5/2010 | Heymes et al. | |
| 2013/0255839 | A1 | 10/2013 | Heymes et al. | |
| 2016/0237532 | A1 * | 8/2016 | Danielou | C22C 1/026 |
| 2019/0136356 | A1 | 5/2019 | Heymes et al. | |

OTHER PUBLICATIONS

PCT International Search Report for PCT/FR2018/050887, dated Jul. 11, 2018.

Goma, et al., "Effect of extrusion aspect ration and test temperatures on fatigue crack growth behavior of a 2099-T83 Al—Li alloy," International Journal of Fatigue, vol. 59, pp. 244-253 (2014).

Jinlong, et al., "The passive film characteristics of several plastic deformation 2099 Al—Li alloy," Journal of Alloys and Compounds, vol. 662, pp. 143-149 (2016).

Bois-Brochu, et al., "Modelling of anisotropy of Al—Li 2099 T83 extrusions and effect of precipitate density," Materials Science & Engineering, vol. 673, pp. 581-586 (2016).

Lin, et al., "Microstructural evolution of 2099 Al—Li alloy during friction stir welding process," Materials Characterization, vol. 123, pp. 307-314 (2017).

Balducci, et al., "Thermal stability of the lightweight 2099 Al—Cu—Li alloy: Tensile tests and microstructural investigations after overaging," Materials and Design, vol. 119, pp. 54-64 (2017).

Xiao Yaqing et al., "Pratical Manual of Aluminum Processing Technique", Metallurgical Industry Press, Jan. 31, 2005, pp. 205-206 (translation attached).

* cited by examiner

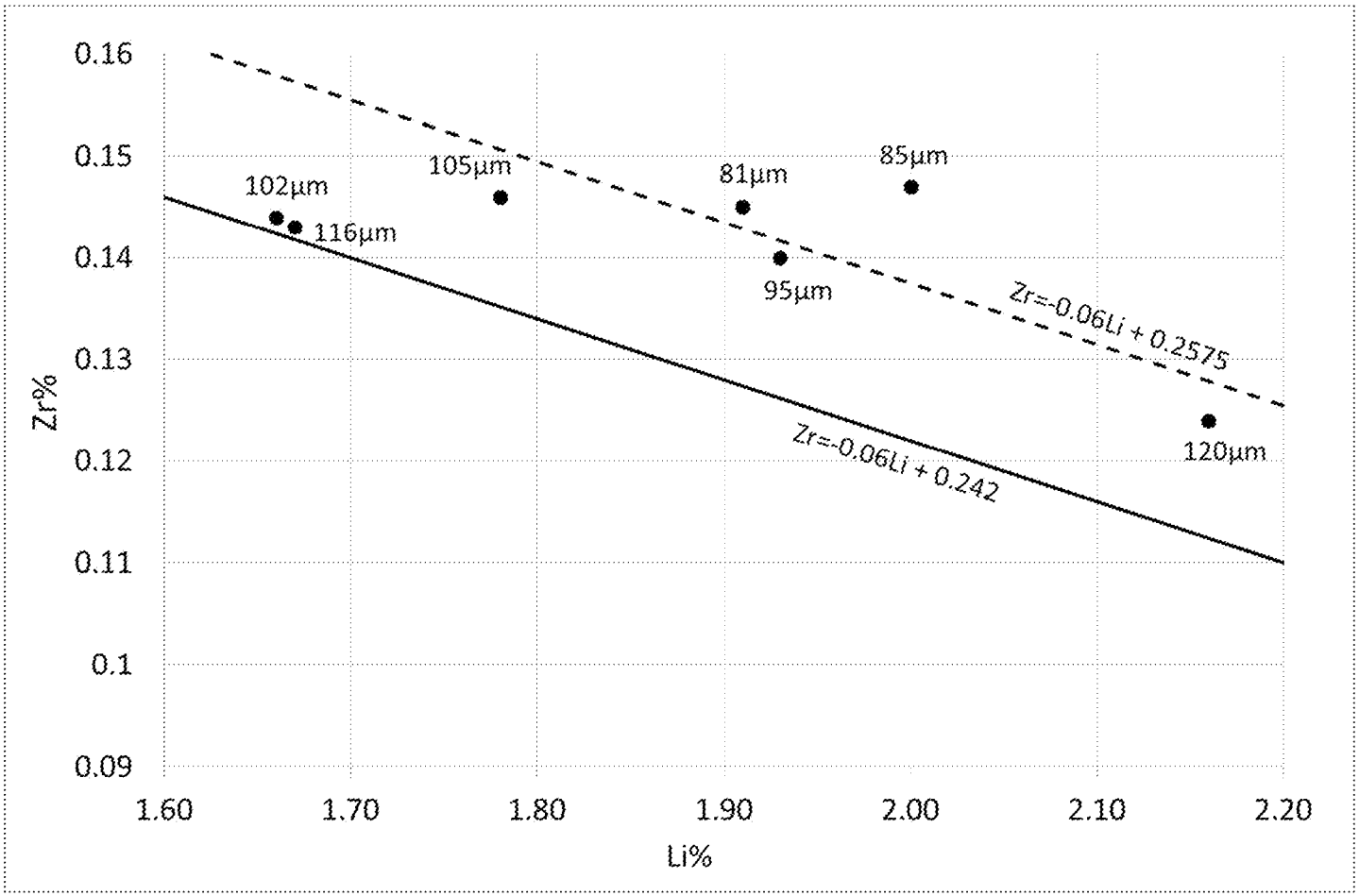
Figure 1: Size of the as-cast grains (µm) of the AlCuLiMgMnZr alloys of example 1 placed in the diagram Zr (% by weight) according to Li (% by weight). The equations Zr = -0.06Li + 0.2575 and Zr = -0.06Li + 0.242 are shown.

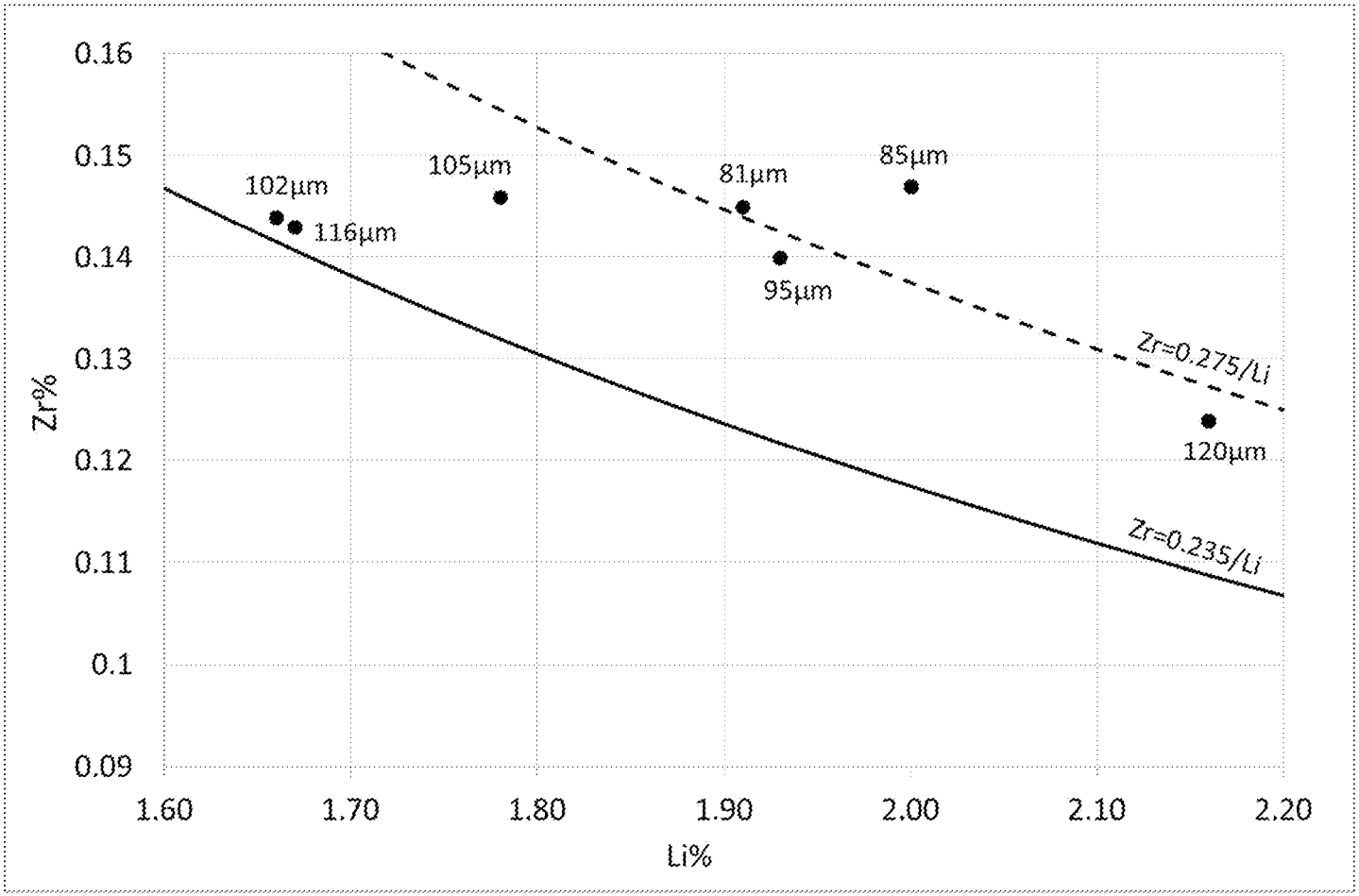
Figure 2: Size of the as-cast grains (µm) of the AlCuLiMgMnZr alloys of example 1 placed in the diagram Zr (% by weight) according to Li (% by weight). The equations Zr = 0.275/Li and Zr = 0.235/Li are shown.

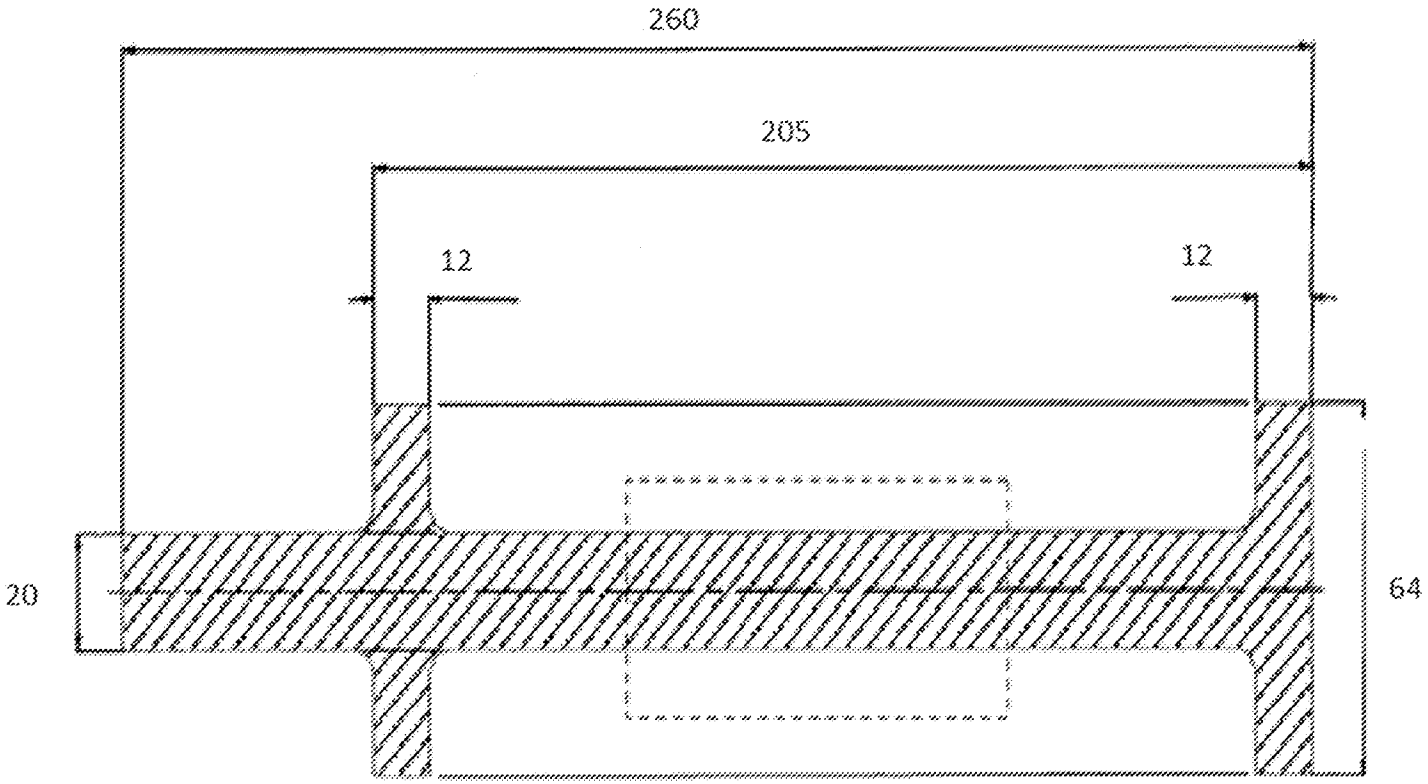
Figure 3: shape of the profiles W of example 2

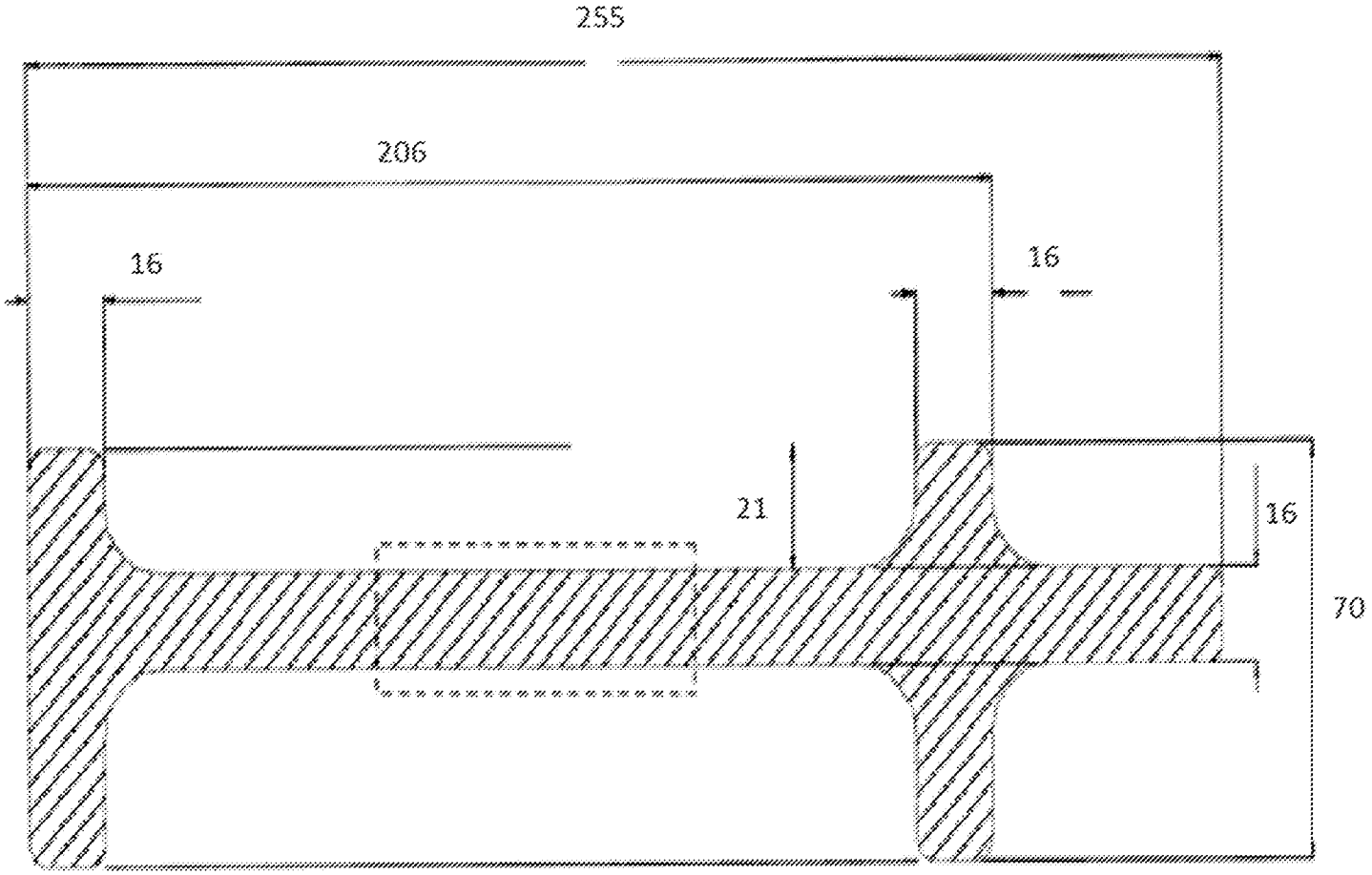
Figure 4: shape of the profiles Z of example 2

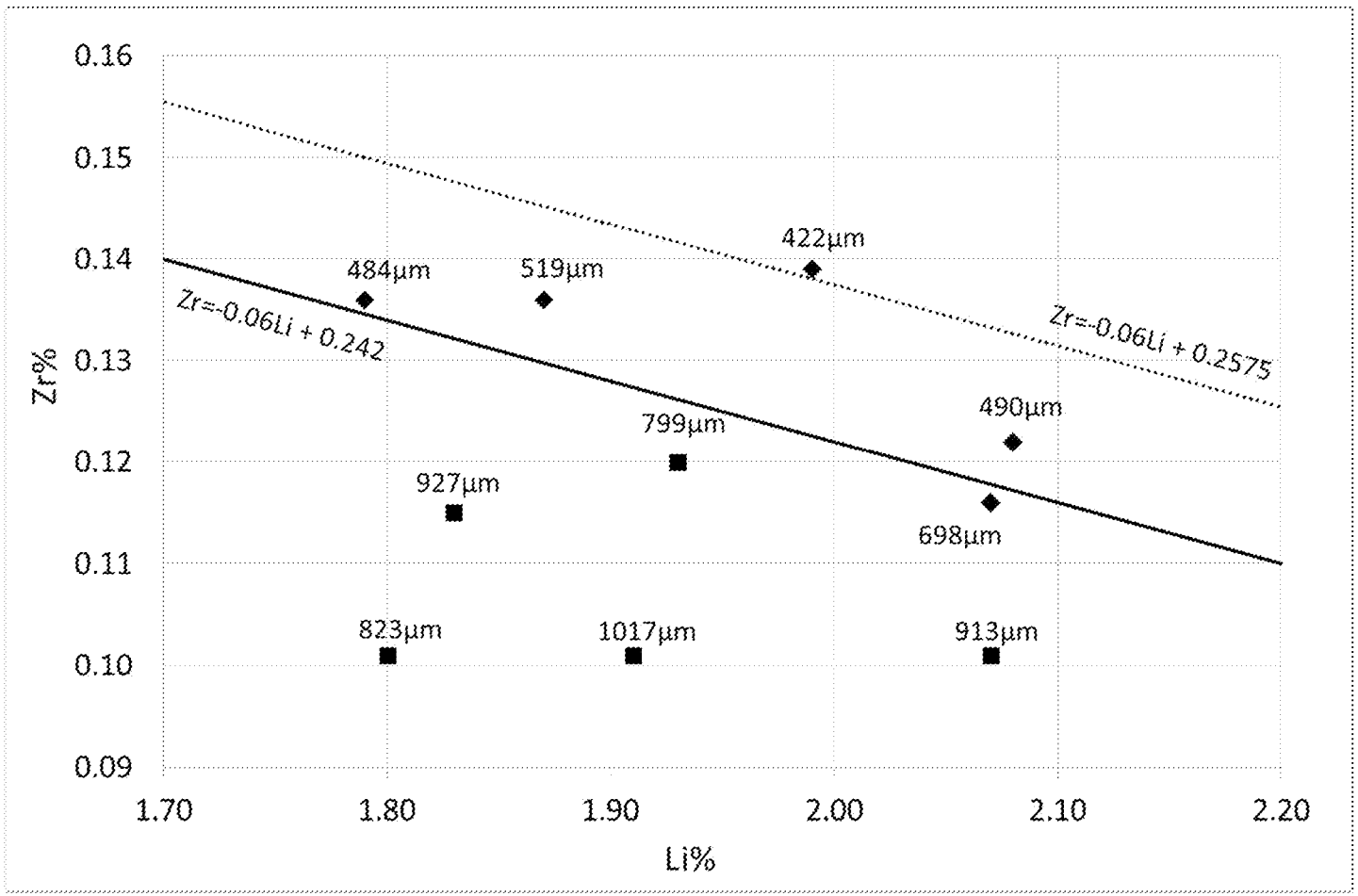
Figure 5: Size of the as-cast grains (µm) of the AlCuLiMgMnZr alloys of example 3 placed in the diagram Zr (% by weight) according to Li (% by weight). The equations Zr = -0.06Li + 0.2575 and Zr = -0.06Li + 0.242 are shown.

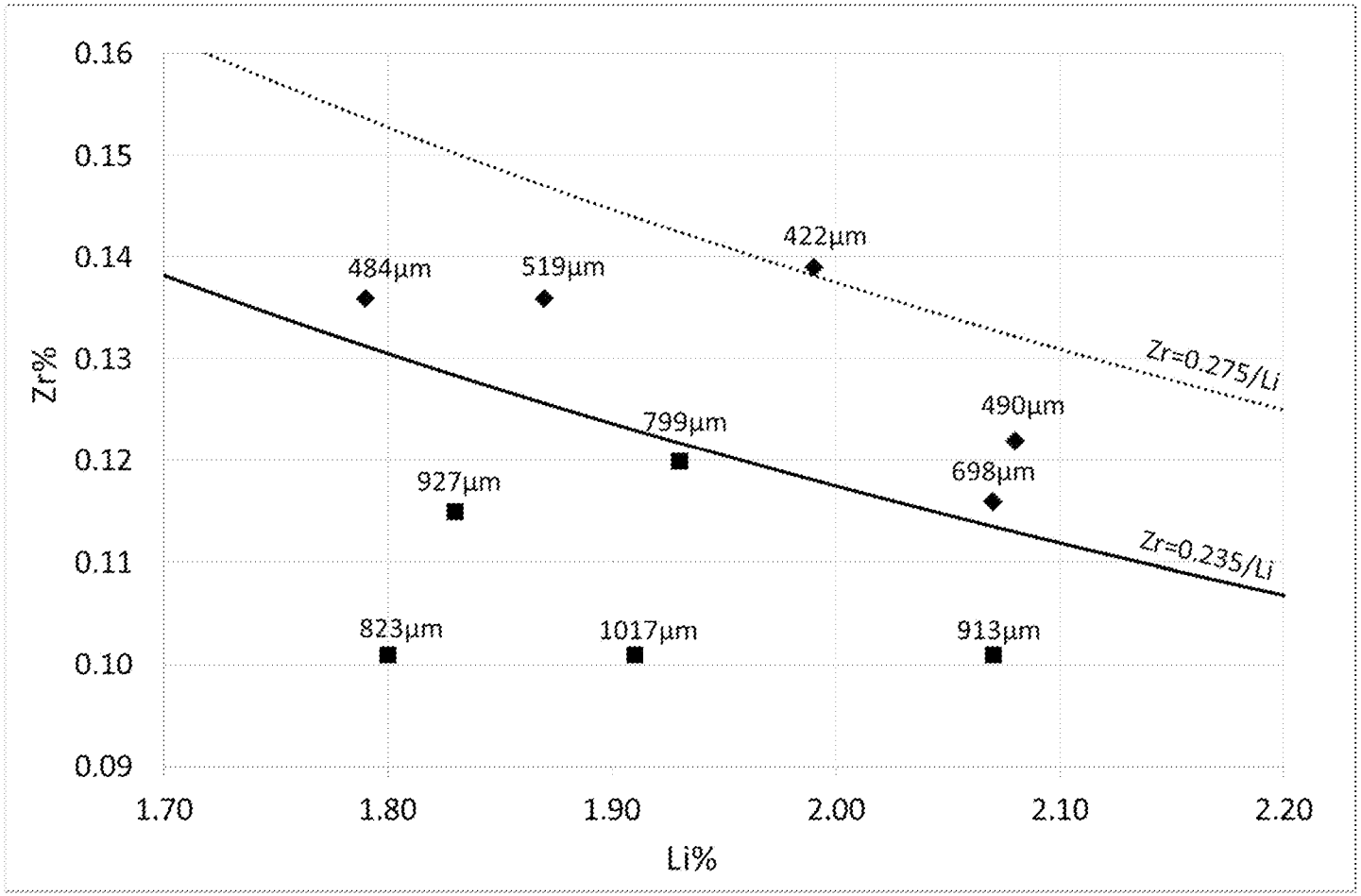
Figure 6: Size of the as-cast grains (µm) of the AlCuLiMgMnZr alloys of example 3 placed in the diagram Zr (% by weight) according to Li (% by weight). The equations Zr = 0.275/Li and Zr = 0.235/Li are shown.

LOW-DENSITY ALUMINUM-COPPER-LITHIUM ALLOY PRODUCTS

CROSS-REFERENCE TO RELATED APPLICATIONS

This application is the National Stage entry of International Application No. PCT/FR2018/050887, filed 9 Apr. 2018, which claims priority to French Application No. 17/53135, filed 10 Apr. 2017.

BACKGROUND

Field

FIELD OF THE INVENTION

The invention relates in general to worked products made from aluminum-copper-lithium alloys, and more particularly such products in the form of profiles intended to make stiffeners in aeronautical construction.

Description of Related Art

A continuous research effort is carried out in order to develop materials that can simultaneously reduce the weight and increase the effectiveness of structures of high-performance airplanes. The aluminum alloys containing lithium are of great interest in this regard, since lithium can reduce the density of the aluminum by 3% and increase the modulus of elasticity by 6% for each percent by weight of lithium added. In order for these alloys to be selected in airplanes, their performance must reach that of the alloys routinely used, in particular in terms of compromise between the properties of static mechanical strength (yield point, ultimate tensile strength) and the properties of damage tolerance (toughness, resistance to the propagation of fatigue cracks), these properties being in general antinomic. These alloys must moreover have sufficient resistance to corrosion, be able to be formed according to the usual methods and have low residual stresses in such a way as to be able to be machined integrally.

A plurality of Al—Cu—Li alloys for which an addition of silver is carried out are known.

The patent U.S. Pat. No. 5,032,359 describes a vast family of aluminum-copper-lithium alloys in which the addition of magnesium and of silver, in particular between 0.3 and 0.5 percent by weight, allows to increase the mechanical strength. These alloys are often known under the trade name Weidalite™.

The patent U.S. Pat. No. 5,198,045 describes a family of Weldalite™ alloys comprising (in % by weight) (2.4-3.5)Cu, (1.35-1.8)Li, (0.25-0.65)Mg, (0.25-0.65)Ag, (0.08-0.25) Zr. The worked products manufactured with these alloys combine a density of less than 2.64 g/cm$^3$ and an attractive compromise between the mechanical strength and the toughness.

The patent U.S. Pat. No. 7,229,509 describes a family of Weldalite™ alloys comprising (in % by weight) (2.5-5.5)Cu, (0.1-2.5) Li, (0.2-1.0) Mg, (0.2-0.8) Ag, (0.2-0.8) Mn, (up to 0.4) Zr or other elements such as Cr, Ti, Hf, Sc and V. The examples presented have an improved compromise between the mechanical strength and the toughness but their density is greater than 2.7 g/cm$^3$.

The patent application WO2007/080267 describes a Weldalite™ alloy not containing zirconium intended for fuselage sheets comprising (in % by weight) (2.1-2.8) Cu, (1.1-1.7) Li, (0.2-0.6) Mg, (0.1-0.8) Ag, (0.2-0.6) Mn.

Moreover, the alloy AA2196 is known, comprising (in % by weight) (2.5-3.3)Cu, (1.4-2.1) Li, (0.25-0.8) Mg, (0.25-0.6) Ag, (0.04-0.18) Zr and at most 0.35 Mn.

The limitation of the quantity of silver is economically very favorable. However, it is noted that the products according to the prior art made of alloy substantially not containing any silver, for example AA2099, do not allow to obtain properties as advantageous as those of the products made with alloys containing silver such as the alloy AA2196. Namely, the advantageous compromise between the mechanical strength and the toughness is not achieved, while maintaining a satisfactory resistance to corrosion.

There is a need for products made of aluminum-copper-lithium alloy having a particularly low density and improved properties with respect to those of the known products substantially not containing any silver, in particular in terms of compromise between the properties of static mechanical strength and the properties of damage tolerance, of resistance to corrosion. These products made of aluminum-copper-lithium alloy must further be able to be manufactured using robust and economically advantageous methods, that is to say generating little rejection related in particular to problems of hot cracks and allowing the use of a significant quantity of recycled alloy.

SUMMARY

A first object of the invention is a product made of alloy containing aluminum comprising, in % by weight, Cu: 2.4-3.2; preferably 2.5-3.0;
Li: 1.6-2.3; preferably 1.7-2.2;
Mg: 0.3-0.9; preferably 0.5-0.7;
Mn: 0.2-0.6; preferably 0.3-0.6;
Zr: 0.12-0.18; preferably 0.13-0.15; and
such that $Zr \geq -0.06*Li+0.242$;
Zn: <1.0 preferably <0.9;
Ag: <0.15; preferably <0.1;
$Fe+Si \leq 0.20$;
optionally at least one element out of Ti, Sc, Cr, Hf and V, the concentration of the element if it is chosen, being:
Ti: 0.01-0.15; preferably 0.01-0.05;
Sc: 0.01-0.15, preferably 0.02-0.1;
Cr: 0.01-0.3, preferably 0.02-0.1;
Hf: 0.01-0.5;
V: 0.01-0.3, preferably 0.02-0.1;
other elements≤0.05 each and ≤0.15 in total, the rest aluminum.

A second object of the invention is a product made of alloy containing aluminum comprising, in % by weight, Cu: 2.4-3.2; preferably 2.5-3.0;
Li: 1.6-2.3; preferably 1.7-2.2;
Mg: 0.3-0.9; preferably 0.5-0.7;
Mn: 0.2-0.6; preferably 0.3-0.6;
Zr: 0.12-0.18; preferably 0.13-0.15; and
such that $Zr*Li \geq 0.235$, preferably $Zr*Li \geq 0.275$;
Zn: <1.0 preferably <0.9;
Ag: <0.15; preferably <0.1;
$Fe+Si \leq 0.20$;
optionally at least one element out of Ti, Sc, Cr, Hf and V, the concentration of the element if it is chosen, being:
Ti: 0.01-0.15; preferably 0.01-0.05;
Sc: 0.01-0.15, preferably 0.02-0.1;
Cr: 0.01-0.3, preferably 0.02-0.1;
Hf: 0.01-0.5;
V: 0.01-0.3, preferably 0.02-0.1;

other elements<0.05 each and <0.15 in total, the rest aluminum.

Another object of the invention is a method for manufacturing an as-cast product made of aluminum alloy according to the invention, comprising the steps of:

a) creating a bath of liquid metal;

b) casting an unwrought product from said bath of liquid metal;

c) solidifying the unwrought product into a billet, a rolling ingot or a forging blank;

characterized in that the casting is carried out without addition of a grain refiner or while adding a refiner comprising (i) Ti and (ii) B or C and such that the concentration of B coming from the refining agent is less than 20 ppm, preferably less than 10 ppm and, even more preferably, less than 5 ppm and that of C less than 3 ppm, preferably less than 2 ppm and, even more preferably, less than 1 ppm and/or characterized in that the casting is carried out, for an unwrought casting product having a thickness E (mm) or having a diameter D (mm) greater than 150 mm at a casting speed v (in mm/min) greater than:

30 to 40 for an unwrought casting product of the plate type, (9000 to 12000)/D for an unwrought casting product of the billet type.

Yet another object of the invention is a method for manufacturing a worked product comprising the casting of an unwrought product according to the method of the invention and steps of rolling or extrusion and/or forging, solution heat treatment, quenching, stress relief and optionally aging.

Yet another object of the invention is a structural element incorporating at least one product obtained by the method for manufacturing a worked product according to the invention or manufactured from a product made of alloy according to the invention.

BRIEF DESCRIPTION OF THE DRAWINGS

FIG. 1 shows the size of the as-cast grains (μm) of the AlCuLiMgMnZr alloys of example 1 placed in the diagram Zr (% by weight) according to Li (% by weight). The equations Zr=−0.06Li+0.2575 and Zr=−0.06Li+0.242 are shown.

FIG. 2 shows the size of the as-cast grains (μm) of the AlCuLiMgMnZr alloys of example 1 placed in the diagram Zr (% by weight) according to Li (% by weight). The equations Zr=0.275/Li and Zr=0.235/Li are shown.

FIG. 3 shows the shape of the profiles W of example 2 ("shape" means the transverse cross-section of said profile).

FIG. 4 shows the shape of the profiles Z of example 2 ("shape" means the transverse cross-section of said profile).

FIG. 5 shows the size of the as-cast grains (μm) of the AlCuLiMgMnZr alloys of example 3 placed in the diagram Zr (% by weight) according to Li (% by weight). The equations Zr=−0.06Li+0.2575 and Zr=−0.06Li+0.242 are shown.

FIG. 6 shows the size of the as-cast grains (μm) of the AlCuLiMgMnZr alloys of example 3 placed in the diagram Zr (% by weight) according to Li (% by weight). The equations Zr=0.275/Li and Zr=0.235/Li are shown.

DETAILED DESCRIPTION OF A PREFERRED EMBODIMENT

Unless otherwise mentioned, all the indications relating to the chemical composition of the alloys are expressed as a percentage by weight based on the total weight of the alloy. The designation of the alloys is done in accordance with the regulations of The Aluminum Association, known to a person skilled in the art. The density depends on the composition and is determined by calculation rather than by a method of measuring weight. The values are calculated in accordance with the procedure of The Aluminum Association, which is described on pages 2-12 and 2.13 of "Aluminum Standards and Data". The definitions of the metallurgical states are indicated in the European standard EN 515 (2009).

Unless otherwise mentioned, the static mechanical characteristics, in other words the ultimate tensile strength $R_m$, the conventional elastic limit at 0.2% of elongation $R_{p0.2}$ ("elastic limit") and the elongation at rupture A, are determined by a tensile test according to the standard EN 10002-1 (2001), the sampling and the direction of the test being defined by the standard EN 485-1 (2016).

The stress intensity factor ($K_Q$) is determined according to the standard ASTM E 399 (2012). Thus, the proportion of the test pieces defined in paragraph 7.2.1 of this standard is always verified just like the overall procedure defined in paragraph 8. The standard ASTM E 399 (2012) gives in paragraphs 9.1.3 and 9.1.4 criteria that allow to determine whether $K_Q$ is a valid value of $K_{1C}$. Thus, a value $K_{1C}$ is always a value $K_Q$ the converse not being true. In the context of the invention, the criteria of paragraphs 9.1.3 and 9.1.4 of the standard ASTM E399 (2012) are not always verified, however for a given test-piece geometry, the values of $K_Q$ presented are always comparable to each other, the geometry of the test piece allowing to obtain a valid value of $K_{1C}$ not always being accessible given the constraints related to the dimensions of the sheets or profiles.

Unless otherwise mentioned, the definitions of the standard EN 12258 (2012) apply. The thickness of the profiles is defined according to the standard EN 2066:2001: the transverse cross-section is divided into elementary rectangles having dimensions A and B; A always being the greatest dimension of the elementary rectangle and B being able to be considered as the thickness of the elementary rectangle.

Here, "structural element" or "structural element" of a mechanical construction designates a mechanical part for which the static and/or dynamic mechanical properties are particularly important for the performance of the structure, and for which a structural calculation is usually prescribed or carried out. These are typically elements, the failure of which may put in danger the safety of said construction, of its users, of its customers or of others. For an airplane, these structural elements comprise in particular the elements that make up the fuselage (such as the fuselage skin), the fuselage stiffeners or stringers, the bulkheads, the fuselage frames (circumferential frames), the wings (such as the wing skin), the stiffeners (stringers or stiffeners), the ribs and spars and the empennage composed namely of horizontal and vertical stabilizers, as well as the floor profiles (floor beams), the seat rails (seat tracks) and the doors.

The present inventors have noted that, surprisingly, for certain AlCuLiMgMnZr alloys having a particularly low density containing less than 0.1% silver by weight and a joint addition of copper, lithium, magnesium and manganese, the specific choice of a particular concentration of zirconium, a function of the concentration of lithium, allows to very significantly improve the robustness of the manufacturing method while maintaining for the product a satisfactory compromise between mechanical strength and damage tolerance. Here, robustness of manufacturing method means generating little rejection related in particular to problems of hot cracks and allowing the use of a significant quantity of recycled alloy.

The product made of alloy containing aluminum according to the invention comprises, in percentage by weight, Cu: 2.4-3.2; preferably 2.5-3.0;

Li: 1.6-2.3; preferably 1.7-2.2;

Mg: 0.3-0.9; preferably 0.5-0.7;
Mn: 0.2-0.6; preferably 0.3-0.6;
Zr: 0.12-0.18; preferably 0.13-0.16; and
such that Zr≥−0.06*Li+0.242 or Zr*Li≥0.235;
Zn: <1.0 preferably <0.9;
Ag: <0.15; preferably <0.1;
Fe+Si≤0.20;
optionally at least one element out of Ti, Sc, Cr, Hf and V, the concentration of said element, if it is chosen, being:
Ti: 0.01-0.15; preferably 0.01-0.05;
Sc: 0.01-0.15, preferably 0.02-0.1;
Cr: 0.01-0.3, preferably 0.02-0.1;
Hf: 0.01-0.5;
V: 0.01-0.3; preferably 0.02-0.1;
other elements <0.05 each and <0.15 in total, the rest aluminum The concentration of copper in the alloy according to the invention for which both the compromise of properties and the improvement of the feasibility of the method are obtained is from 2.4 to 3.2% by weight. In one embodiment the concentration of copper is from 2.5 to 3% by weight and preferably, from 2.6 to 2.9% by weight. In another embodiment the concentration of copper is from 2.4 to 2.6% by weight.

The concentration of lithium in the alloy according to the invention is such that it allows to obtain a product having a particularly attractive density, namely a density of less than 2.63 g/cm$^3$, more particularly less than 2.62 g/cm$^3$ and, even more particularly, less than or equal to 2.61 g/cm$^3$. The concentration of lithium in the alloy is thus greater than 1.6% by weight, preferably greater than 1.7% by weight and, even more preferably, greater than 1.9% by weight. Such a concentration of lithium leads to a very high sensitivity to oxidation, to hydrogenation and to hot cracking leading to difficulties in casting the alloy and, consequently, requires very particular manufacturing methods. The application WO2015/086921 describes in particular the fact that, since lithium is particularly oxidizable, the casting of the aluminum-copper-lithium alloys generates fatigue-crack-initiation sites more numerous than for the alloys of the type 2XXX without lithium. In order to overcome this problem, it has been proposed to carry out the casting in specific conditions, namely conditions such that the concentrations of hydrogen and of oxygen are maintained particularly low and that the casting is of the semi-vertical type using a particular distributor. However, for the particularly high concentrations of lithium in question here, problems of a hot crack or cracking to the core of the unwrought product during casting are further generally noted. In over to overcome this problem, it is generally accepted to carry out the casting at particularly slow speeds and, consequently, at high temperatures in order to avoid the liquid metal, because of its slow flow rate, locally reaching temperatures sufficiently low to induce the formation of floating crystals and primary intermetallics given the high concentration of peritectic elements, in particular Zr. It is thus necessary to control the temperature of the bath of liquid metal during the casting in a particularly precise manner; the slower the metal flow rate, the higher the temperature of the metal in the holding furnace must be, which leads to its exacerbated oxidation.

Besides a control of the compromise between the temperature and the casting speed, the problem of hot cracking can be overcome by greatly refining the alloy during the casting. Indeed, it is known that the risk of hot cracking is even greater as the as-cast grain is rougher. A reduction in the size of grains as well as a change in the shape of the grains can be obtained by adding large quantities of grain-refining agent during the casting. The typical grain-refining agents are Al3% Ti0.15% C, Al1% Ti0.15% C, Al3% Ti1% B and Al5% Ti1% B in the form of a wire generally added in line. The addition of these agents leads to the dispersion of fine particles of boride or of carbide in the liquid metal which will act as sites of nucleation of the grains during the solidification. However, the addition of a large quantity of grain-refining agents is not desirable in particular when it is desired to be able to maintain a high level of recycling in the method for manufacturing the alloy. Indeed, the addition of grain-refining agents comprising titanium as well as that of remeltings of alloys also containing titanium rapidly causes, over the cycles of production of the alloy, an increase in the total titanium concentration of the alloy, which degrades the properties of damage tolerance of the worked product and thus limits the possible addition of recycled metal into the load.

The present inventors have brought to light, in a totally surprising manner, that an AlCuLiMgMnZr alloy according to the invention, having namely particular concentrations of Li and of Zr, allows to improve the robustness of the manufacturing method and limit or even eliminate the addition of grain-refining agent.

The concentration of lithium in the alloy according to the invention is thus greater than 1.6% by weight, preferably greater than 1.7% by weight and, even more preferably, greater than 1.9% by weight. Advantageously the concentration of Li in the alloy is 1.7 to 2.3% by weight or even 2.0 to 2.2% by weight. The high concentration of lithium exacerbates in particular the sensitivity to oxidation of the bath of liquid metal, favors the problems of cracking to the core during the casting which requires reducing the casting speed.

The concentration of zirconium is from 0.12 to 0.18% by weight; preferably from 0.13 to 0.16% by weight; and more preferably from 0.14 to 0.15% by weight.

It has thus been brought to light that for the aforementioned specific concentrations of lithium and zirconium, it is possible to manufacture using a robust method an alloy according to the invention, the as-cast grain size of which is particularly advantageous, namely limiting the risk of hot cracking during the casting.

Without deducing therefrom any given theory, the present inventors think that the precisely selected composition of the alloy according to the invention allows the formation of $Al_3Zr$ and $Al_3(Zr, Li)$ cubic crystalline phases which are structurally similar to the $Al_3Li$ metastable phase which is known for precipitating via demixing of the solid solution during an aging after solution heat treatment and quenching but which is not supposed to form from the liquid, the known stable form being the tetragonal variety. The formation of such phases via the specifically selected composition of the alloy could be responsible for sites of nucleation of the grains during the solidification of the unwrought casting product thus allowing the formation of an extremely fine grain structure in the presence of a conventional quantity of grain-refining agent or allowing to limit, optionally to eliminate, the addition of grain-refining agent during the casting.

The present inventors have thus brought to light a particular compromise between the concentrations of zirconium and of lithium such that it allows to obtain both a satisfactory compromise of properties for the worked product and to significantly improve the robustness of the method for manufacturing said product made of AlCuLiMgMnZr alloy, in particular of the casting step of this method. Thus, the concentration of zirconium in the alloy according to the invention is advantageously such that Zr≥−0.06*Li+0.242, preferably such that Zr≥−0.06*Li+0.2575. In another embodiment, the concentrations of Li and Zr in the alloy according to the invention are such that Zr*Li≥0.235, preferably Zr*Li≥0.242, more preferably Zr*Li≥0.275.

The concentration of magnesium is from 0.3 by 0.9% by weight and, preferably, from 0.5 by 0.7% by weight. The magnesium, in the particular alloy composition of the present invention, contributes to favoring the obtaining of a fine as-cast grain.

The concentration of manganese is from 0.2 to 0.6% by weight, preferably from 0.3 to 0.6% by weight and, even more preferably from 0.4 to 0.5% by weight. The manganese allows in particular to achieve a satisfactory compromise of properties for the worked product. The concentration of silver is less than 0.15% by weight, preferably less than 0.1% by weight and, even more preferably less than 0.05% by weight. The present inventors have noted that the advantageous compromise between the mechanical strength and the damage tolerance known for alloys typically containing approximately 0.3% silver by weight can be obtained for alloys substantially not containing any silver with the composition selection carried out.

The concentration of zinc is less than 1.0% by weight, preferably less than 0.9% by weight.

According to a first specific embodiment, the concentration of zinc is between 0.1 and 0.5% by weight and preferably between 0.2 and 0.4% by weight. According to a second specific embodiment, the concentration of zinc is less than 0.05% by weight.

The alloy also contains at least one element that can contribute to controlling the grain size chosen from Ti, Cr, Sc, Hf and V, the quantity of the element, if it is chosen, being from 0.01 to 0.15% by weight, preferably 0.01 to 0.05% for Ti, from 0.01 to 0.15% by weight, preferably 0.02 to 0.1% by weight for Sc, from 0.01 to 0.3% by weight and preferably from 0.02 to 0.1% by weight for Cr and V and from 0.01 to 0.5% by weight for Hf. According to an advantageous embodiment, titanium is chosen in the aforementioned concentrations and even more advantageously in a concentration ranging from 0.01 to 0.03% by weight.

It is preferable to limit the concentration of the inevitable impurities in the alloy in such a way as to achieve the most favorable properties of damage tolerance. The inevitable impurities comprise iron and silicon, these impurities have a total concentration of less than 0.20% by weight and preferably respectively a concentration of less than 0.08% by weight and 0.06% by weight for iron and silicon; the other elements are impurities that preferably have a concentration of less than 0.05% by weight each and 0.15% by weight in total.

The method for manufacturing the unwrought casting products according to the invention comprises steps of production, casting and solidification of the unwrought product. These steps are followed, for the production of the worked products according to the invention, by the steps of rolling or extrusion and/or forging, solution heat treatment, quenching, stress relief and optionally aging.

In a first embodiment of the unwrought casting products, a bath of liquid metal is produced, an unwrought product is cast from said bath of liquid metal and a solidification of the unwrought product into a billet, a rolling ingot or a forging blank is carried out. In this first embodiment, the casting step is carried out without addition of grain refiner or while adding a refiner comprising (i) Ti and (ii) boron, B, or carbon, C, and such that:

- the concentration of B coming from the refining agent is less than 45 ppm, preferably less than 20 ppm, preferably less than 10 ppm and, even more preferably, less than 5 ppm,
- the concentration of C is less than 6 ppm, preferably less than 3 ppm, preferably less than 2 ppm and, even more preferably, less than 1 ppm.

In a second embodiment of the unwrought casting products, a bath of liquid metal is produced, an unwrought product is cast from said bath of liquid metal and a solidification of the unwrought product into a billet, a rolling ingot or a forging blank is carried out. In this second embodiment, the casting is carried out, for an unwrought casting product having a thickness or having a diameter D greater than 150 mm at a casting speed v (in mm/min) greater than:

- 30 for an unwrought casting product of the plate type,
- 9000/D for an unwrought casting product of the billet type.

These two embodiments can advantageously be combined.

Preferably, the grain size of the AlCuLiMgMnZr alloy according to the invention in the as-cast state, obtained by one of the methods according to the invention, is less than 110 μm, preferably less than or equal to 105 μm and, even more preferably less than 100 μm for unwrought casting products having a thickness or having a diameter greater than 150 mm, preferably greater than 250 mm and more preferably greater than 300 mm. In an embodiment additionally preferred, the grain size of the AlCuLiMgMnZr alloy according to the invention in the as-cast state, obtained by one of the methods according to the invention, is less than or equal to 95 μm, preferably less than 90 μm for unwrought casting products having a thickness or having a diameter greater than 150 mm, preferably greater than 250 mm and more preferably greater than 300 mm.

The as-cast grain size is measured, from samples have been sampled at mid-radius (R/2) of the billets, according to the intercept method, in accordance with the standard ASTM E112. The unwrought casting products according to the invention allow the production of worked products, that is to say of extruded, rolled and/or forged products. The method for manufacturing the worked products according to the invention comprises the steps of rolling, extrusion and/or forging, solution heat treatment, quenching, stress relief and optionally aging in one or more steps.

Preferably, the worked products according to the invention are extruded products. The method for manufacturing the extruded product according to the invention comprises the steps of:

a) homogenizing of the billet;
b) hot and optionally cold working of the billet into an extruded product;
c) solution heat treatment and quenching of said extruded product;
d) optionally, stretching in a controlled manner of said extruded product with a permanent set from 1 to 15%, preferably of at least 2%;
e) optionally, aging at 140-170° C. for 5 to 70 hours.

The products according to the invention can advantageously be used in structural elements, in particular of an airplane. Thus, an object of the invention is a structural element incorporating at least one product according to the invention or a product manufactured using a method according to the invention.

The use, of a structural element incorporating at least one product according to the invention or manufactured from such a product is advantageous, in particular for aeronautical construction. The products according to the invention are particularly advantageous for the creation of structural elements such as fuselage or wing stiffeners, floor beams and seat rails. These aspects, as well as others of the invention are explained in more detail using the following illustrative and non-limiting examples.

Example 1

In this example, a plurality of billets made from an AlCuLiMgMnZr alloy having a diameter of 384 mm were cast. The casting was carried out in the presence of 4 kg/ton of $AT_5B$, at a speed of 25 to 35 mm/min and a temperature between 675 and 700° C. The composition of the alloys and their density are given in table 1.

TABLE 1

Composition in % by weight and density of the AlCuLiMgMnZr alloys

| Alloy | Cu | Li | Mg | Zn | Ag | Mn | Zr | Ti | Density (g/cm$^3$) |
|---|---|---|---|---|---|---|---|---|---|
| AA2196 | 2.5-3.3 | 1.4-2.1 | 0.25-0.8 | ≤0.35 | 0.25-0.6 | ≤0.35 | 0.04-0.18 | ≤0.1 | 2.63 |
| 68 | 3.00 | 1.67 | 0.35 | 0.52 | 0.02 | 0.06 | 0.143 | 0.040 | 2.63 |
| 69 | 3.00 | 1.66 | 0.33 | 0.52 | 0.05 | 0.31 | 0.144 | 0.041 | 2.63 |
| 70 | 2.55 | 1.78 | 0.62 | 0.52 | 0.02 | 0.32 | 0.146 | 0.040 | 2.62 |
| 71 | 2.56 | 2.00 | 0.61 | 0.51 | 0.02 | 0.33 | 0.147 | 0.038 | 2.60 |
| 72 | 2.45 | 1.91 | 0.63 | 0.82 | 0.06 | 0.32 | 0.145 | 0.038 | 2.61 |
| 73 | 2.52 | 2.16 | 0.59 | 0.60 | 0.01 | 0.08 | 0.124 | 0.041 | 2.59 |
| 76 | 2.49 | 1.93 | 0.57 | 0.049 | 0.03 | 0.32 | 0.140 | 0.038 | 2.60 |

Fe + Si ≤0.2% by weight, other elements ≤0.05% by weight each and ≤0.15% in total Samples were taken at mid-radius (R/2) of the billets in order to measure the size of the as-cast grains. The size of the as-cast grains was measured according to the intercept method, in accordance with the standard ASTM E112. The size of the as-cast grains is given in table 2 below. The results are presented in FIGS. 1 and 2.

TABLE 2

Size of the as-cast grains of the AlCuLiMgMnZr alloys

| Alloy | Size of grains (μm) |
|---|---|
| AA2196 | 250 to 320 |
| 68 | 116 |
| 69 | 102 |
| 70 | 105 |
| 71 | 85 |
| 72 | 81 |
| 73 | 120 |
| 76 | 95 |

Example 2

In this example, billets made of alloy AA2196 (alloy 2 and 5), the composition of which is given in table 3 below, were homogenized 8 h at 500° C. then 24 h at 527° C. (alloy 2) or 8 h at 520° C. (alloy 5). Billets made of alloy 76 of example 1 were homogenized 10 h at 534° C. After homogenizing, the billets were then heated to 450° C.+/−40° C. then hot extruded in order to obtain profiles W according to FIG. 3 for the alloy 2 and Z according to FIG. 4 for the alloys 5 and 76. The profiles thus obtained were solution heat treated at 524° C., quenched and stretched with a permanent elongation of between 2 and 5%. The aging was carried out for 48 h at 152° C.

TABLE 3

Composition in % by weight and density of the alloy AA2196

| Alloy | Si | Fe | Cu | Mn | Mg | Zn | Ti | Zr | Li | Ag | Density (g/cm$^3$) |
|---|---|---|---|---|---|---|---|---|---|---|---|
| 2 | 0.04 | 0.05 | 2.83 | 0.33 | 0.36 | 0.02 | 0.02 | 0.11 | 1.59 | 0.38 | 2.64 |
| 5 | 0.03 | 0.04 | 2.90 | 0.31 | 0.40 | 0.01 | 0.03 | 0.1 | 1.67 | 0.38 | 2.64 |

Other elements ≤0.05% by weight each and ≤0.15% in total

Samples taken at profile end were tested in order to determine their static mechanical properties as well as their toughness ($K_q$). The location of the samples is indicated by dotted lines in FIGS. 3 and 4. The test pieces used for the measurement of the static properties had a diameter of 10 mm and were sampled in such a way that the direction of the axis of the test piece corresponded to the direction of extrusion (direction L). The test pieces used for the measurements of toughness were of the CT type and had the characteristics B=20 mm and W=50 mm and were machined in such a way that the direction of loading corresponded to the direction of extrusion and the direction of propagation was perpendicular to the direction of extrusion and contained in the plane of FIGS. 3 and 4 (configuration L-T).

The results obtained are presented in table 4.

TABLE 4

Elastic limit Rp0.2 (L) in MPa and toughness Kq (L-T) in MPa√m

| Alloy | Rp0.2(L) | Kq (L-T) |
|---|---|---|
| 2 | 522 | 37.6 |
| 5 | 536 | 38.2 |
| 76 | 512 | 43.4 |

Example 3

Various alloys, the specific composition of which is described in detail in table 5, were solidified in the form of experimental slugs according to the standard published by The Aluminium Association "TP-1/Standard Test Procedure for Aluminum Alloy Grain Refiners" (2012). The slugs were thus obtained by solidification of the liquid alloy in spoons made of soft steel having a thickness of 3 mm.

To do this, a bath of liquid metal was created in a melting furnace, the composition of the liquid metal is that of the solidified alloys, the later solidification being carried out without the conventional addition of refiner in such a way as to bring to light the intrinsic contribution of the composition of the alloy to the nucleation law. The grain sizes obtained are different than those obtained in vertical casting in the presence of refiner, but the possibility of self-inoculation of the alloy in a certain domain of composition can be brought to light by this test which thus allows to specify the position of the border of the domain of interest in the plane Zr vs Li. At the studied surface described in detail below, the speed of cooling is 3.5 $K.s^{-1}$.

Upon complete cooling, the slug, which has the shape of a truncated cone having a height of 65 mm and the circular bases of which have respective radii of 25 mm and 65 mm, is removed from the mold and cut according to its axis. The measurement of grain is carried out at 38 mm of the small face.

The upper portion of the slug thus cut was polished and then underwent anodic oxidation before being observed under polarized light. The grain size was measured on this upper portion thus prepared by an intercept method according to the standard ASTM E112.

The grain size is presented in table 5 and in FIGS. 5 et 6.

TABLE 5

Composition in % by weight and density of the AlCuLiMgMnZr alloy used

| Alloy | Si (%) | Fe (%) | Cu (%) | Mn (%) | Mg (%) | Ti (%) | Li (%) | Zr (%) | Grain size (μm) |
|---|---|---|---|---|---|---|---|---|---|
| 1 | 0.02 | 0.037 | 3.22 | 0.31 | 0.37 | 0.03 | 1.80 | 0.101 | 823 |
| 2 | 0.02 | 0.039 | 3.25 | 0.31 | 0.36 | 0.03 | 1.91 | 0.101 | 1017 |
| 3 | 0.02 | 0.039 | 3.31 | 0.31 | 0.38 | 0.03 | 2.07 | 0.101 | 913 |
| 4 | 0.02 | 0.038 | 3.26 | 0.31 | 0.37 | 0.03 | 1.83 | 0.115 | 927 |
| 5 | 0.02 | 0.038 | 3.25 | 0.31 | 0.37 | 0.03 | 1.93 | 0.120 | 799 |
| 6 | 0.02 | 0.039 | 3.31 | 0.31 | 0.36 | 0.03 | 2.07 | 0.116 | 698 |
| 8 | 0.02 | 0.040 | 3.3 | 0.31 | 0.50 | 0.03 | 2.08 | 0.122 | 490 |
| 10 | 0.02 | 0.039 | 3.21 | 0.31 | 0.33 | 0.03 | 1.79 | 0.136 | 484 |
| 11 | 0.02 | 0.040 | 3.25 | 0.30 | 0.33 | 0.03 | 1.87 | 0.136 | 519 |
| 12 | 0.03 | 0.042 | 3.21 | 0.30 | 0.33 | 0.03 | 1.99 | 0.139 | 422 |

Fe + Si ≤0.2% by weight, other elements ≤0.05% by weight each and ≤0.15% in total

The invention claimed is:

1. An as-cast product comprising an alloy containing aluminum comprising, in % by weight, Cu: 2.4-3.2;
Li: 1.6-2.3;
Mg: 0.3-0.9;
Mn: 0.2-0.6;
Zr: 0.12-0.18; and
such that Zr≥-0.06*Li+0.242 or Zr*Li≥0.235,
Zn: <1.0;
Ag: <0.15;
Fe+Si≤0.20;
optionally at least one element selected from the group consisting of Ti, Sc, Cr, Hf and V, the concentration of the element if chosen, being in % by weight:
Ti: 0.01-0.15;
Sc: 0.01-0.15;
Cr: 0.01-0.3;
Hf: 0.01-0.5;
V: 0.01-0.3;
other elements ≤0.05 each and ≤0.15 in total, the rest aluminum;
manufactured by a method comprising:
a) producing a bath of liquid metal;
b) casting an unwrought product from said bath of liquid metal;
c) solidifying the unwrought product into a billet, a rolling ingot or a forging blank;
wherein the casting is carried out without addition of a grain refiner or adding a refiner comprising (i) Ti and (ii) B or C, such that the concentration of B coming from a refining agent is less than 45 ppm, and the concentration of C is less than 6 ppm,
wherein the product after step c) is an as-cast product;
wherein the as-cast product has a thickness or a diameter greater than 150 mm, and a grain size less than 110 μm.

2. The as-cast product according to claim 1, having a thickness or having a diameter greater than 250 mm and having a grain size less than 105 μm.

3. The as-cast product according to claim 1, having a thickness or having a diameter greater than 300 mm, and having a grain size less than 90 μm.

4. The as-cast product according to claim 1, wherein the concentration of manganese is from 0.3 to 0.6% by weight.

* * * * *